US005441270A

United States Patent [19]

Williams

[11] Patent Number: 5,441,270

[45] Date of Patent: Aug. 15, 1995

[54] STRAIGHT HITTING AID FOR GOLFERS

[76] Inventor: Willard B. Williams, 375 R.D. #2 Mitchell Rd., West Middlesex, Pa. 16159

[21] Appl. No.: 294,646

[22] Filed: Aug. 23, 1994

[51] Int. Cl.[6] ..... A63B 69/36

[52] U.S. Cl. ..... 273/186.2; 273/186.4

[58] Field of Search ..... 273/194 R, 194 A, 163 R, 273/163 A, 186.2, 164, 186.4, 187.4

[56] References Cited

U.S. PATENT DOCUMENTS

| | | | |
|---|---|---|---|
| D. 111,855 | 10/1938 | Moreno | 273/163 R X |
| D. 150,497 | 8/1948 | Forsell | 273/163 R X |
| D. 188,677 | 8/1960 | Thornson | 273/163 R |
| 1,331,499 | 2/1920 | Hartford | 273/163 R |
| 2,771,678 | 11/1956 | Hansen, Sr. | 273/163 R X |
| 3,033,574 | 5/1962 | Partridge | 273/163 R |
| 3,198,525 | 8/1965 | Smith | 273/163 R |
| 3,273,892 | 9/1966 | Nolting | 273/163 R |
| 3,273,893 | 9/1966 | Duncan | 273/194 R X |
| 3,298,693 | 1/1967 | Eisenberg | 273/163 R |
| 4,053,160 | 10/1977 | Salata | 273/163 R |
| 4,174,838 | 11/1979 | Paschetto | 273/163 A |
| 4,468,034 | 8/1984 | Duclos | 273/194 A X |
| 4,629,193 | 12/1986 | Pierman | 273/164 |
| 4,647,045 | 3/1987 | Bilyeu | 273/163 A |
| 4,819,943 | 4/1989 | Szczepanski | 273/164 X |
| 4,949,971 | 8/1990 | Thornton | 273/163 A X |
| 5,052,690 | 10/1991 | Sharp | 273/163 A X |
| 5,135,228 | 8/1992 | Hawkins et al. | 273/194 A X |
| 5,152,533 | 10/1992 | Radakovich | 273/163 A X |

*Primary Examiner*—George J. Marlo
*Attorney, Agent, or Firm*—Penrose Lucas Albright

[57] ABSTRACT

A method and apparatus for training a beginning golfer to stroke a golf club so that he or she hits a golf ball in a straight direction toward a desired target without the golf ball being hooked or spliced, wherein a pointer which is secured to the shaft of the golf club is aligned to be perfectly parallel with another pointer which is detachably connected to the face of the golf club so that it extends perpendicularly therefrom, the pointer on the face of the golf club being removed and the pointer on the shaft having been clamped in the aforesaid disposition, the golfer then by swinging the golf club so that the pointer moves perfectly rectilinearly to hit the golf ball with the pointer being pointed in a parallel direction toward the desired target, the golf ball is hit straight toward the target. The golf club can be a putter, iron, or wood and the pointer which is temporarily connected to the face of the head of the club may be connected by a magnet or resilient clamp or other resilient members such as elastic bands for nonmagnetic golf club faces. The pointer is attached by clamp to the shaft of the club so as to be movable in a horizontal plane about the longitudinal axis of the club and in a vertical plane that coincides with the axis of the club. This pointer may also be pivoted upwardly and secured against the shaft for storage and transportation purposes.

10 Claims, 3 Drawing Sheets

STRAIGHT HITTING AID FOR GOLFERS

FIELD OF THE INVENTION

This invention relates generally to golfing equipment, and more particularly to a device to improve the golfer's stroke and aim when putting or otherwise driving a golf ball toward a designated target.

BACKGROUND OF THE INVENTION

Golf is an increasingly popular sport. It is well-known that mastery of the sport depends, in a large part, on the ability to drive the golf ball in the direction that the golfer intends to drive it. To do this the face of the golf club head must contact the golf ball at the correct point and at the correct angle during the golfer's swing. The inability of golfers, particularly novice golfers, to grasp this technique frustrates the advancement in the sport of many golfers.

Of methods and apparatuses for improving the technique of golfers in hitting golf balls, there are many patents that comprise the prior art. For example, U.S. Pat. No. 1,331,499 issued to E. V. Hartford on Feb. 24, 1920, U.S. Pat. No. 2,771,678 of F. C. Hansen, Sr. which issued on Nov. 27, 1956, U.S. Pat. No. 3,198,525 to H. W. Smith on Aug. 3, 1965, U.S. Pat. No. 3,273,893 issued to J. B. Duncan on Sep. 20, 1966, U.S. Pat. No. 3,298,693 of W. Eisenberg which issued on Jan. 17, 1967, U.S. Pat. No. 4,053,160 issued to J. M. Salata on Oct. 11, 1977, U.S. Pat. No. 4,174,838 to P. E. Paschetto on Nov. 20, 1979, U.S. Pat. No. 4,949,971 issued to C. J. Thorton which was issued on Aug. 21, 1990 and U.S. Pat. No. 5,152,533 to D. L. Radakovich on Oct. 6, 1992 all disclose devices attached to the golf club shaft to improve the golfers' accuracy when hitting golf balls. However, these devices, being connected to the club's shaft, tend to be inherently less than precise for providing optimum striking dispositions by the faces of golf clubs. In other words, they fail to disclose means for precisely calibrating the device so that the golf ball is hit at the correct point of contact and the motion of the club and angle of the striking plate is such that the ball is caused to travel in the desired direction. However prior art exemplified by U.S. Pat. No. Des. 111,855 that issued to F. Moreno on Oct. 25, 1938, U.S. Pat. No. Des. 150,497 issued to C. F. Forsell dated Aug. 10, 1948, U.S. Pat. No. Des. 188,677 to I. T. Thomson on Aug. 23, 1960, U.S. Pat. No. 3,033,574 issued to H. F. Partridge on May 8, 1962, an alternate embodiment in U.S. Pat. No. 3,198,525 of H. W. Smith which was issued on Aug. 3, 1965, U.S. Pat. No. 3,273,892 to R. E. Nolting on Sep. 20, 1966 and U.S. Pat. No. 4,647,045 to R. M. Bilyeu dated Mar. 3, 1987 disclose a variety of devices for improving the techniques of golfers by attaching a device either very close to or on the face of the golf club head which is used when striking the golf ball, thus making the device's use impractical for use on any club other than a putter. Also, U.S. Pat. No. 5,052,690 issued to J. R. Sharp on Oct. 1, 1991 involves a mirror mounted on top of the golf club head which is impractical for most conventional golf club heads except the putter. Additionally, U.S. Pat. No. 4,629,193 issued to M. J. Pierman on Dec. 16, 1986 and U.S. Pat. No. 4,819,943 of H. Szczepanski dated Apr. 11, 1989 provide unconventional golf clubs for improving golfers' hitting technique.

A need therefore exists for apparatus which is suitable for use with conventional golf clubs that accurately relates to the position of the golf club's head's face when golf balls are hit, to assist golfers in not only putting but also for driving golf balls in the direction they are aimed.

SUMMARY OF THE INVENTION

To assist the golfer's hitting technique, the object of the invention is to provide a pointer that is suitably and readily attached to the shaft of the golf club for use in directing the club's stroke, its specific location, secured to the club's shaft, being directionally determined by making it parallel to a cooperative pointing device that is removably attached to the face of the golf club head to extend normally therefrom.

Other objects, adaptabilities and capabilities will appear as the description progresses, reference being made to the accompanying drawings in which:

DESCRIPTION OF THE PREFERRED EMBODIMENTS

Figure 1:
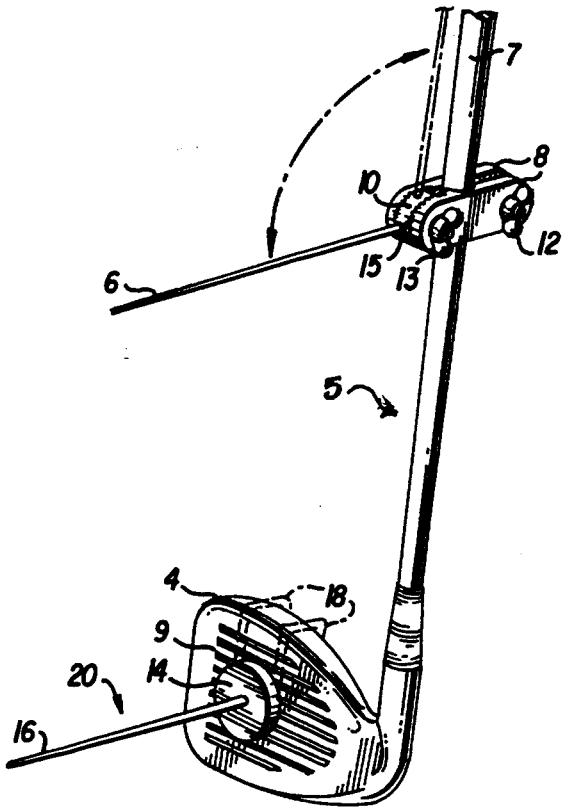
FIG. 1 is a perspective view of cooperating devices in accordance with the invention, attached to a golf club.
Figure 2:
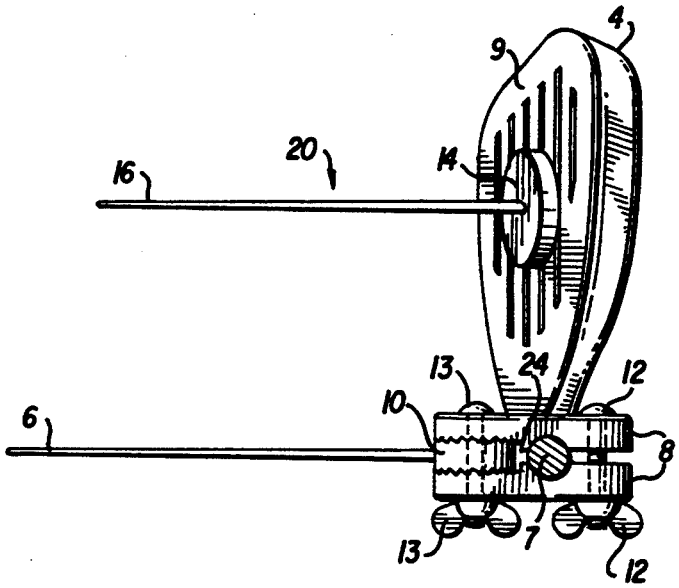
FIG. 2 is a plan view of the apparatus shown in FIG. 1, illustrating how the pointer on the shaft is aligned with the pointer on the club's face to ensure that the golf ball will be struck by the golf club's face in the direction desired.
Figure 7:
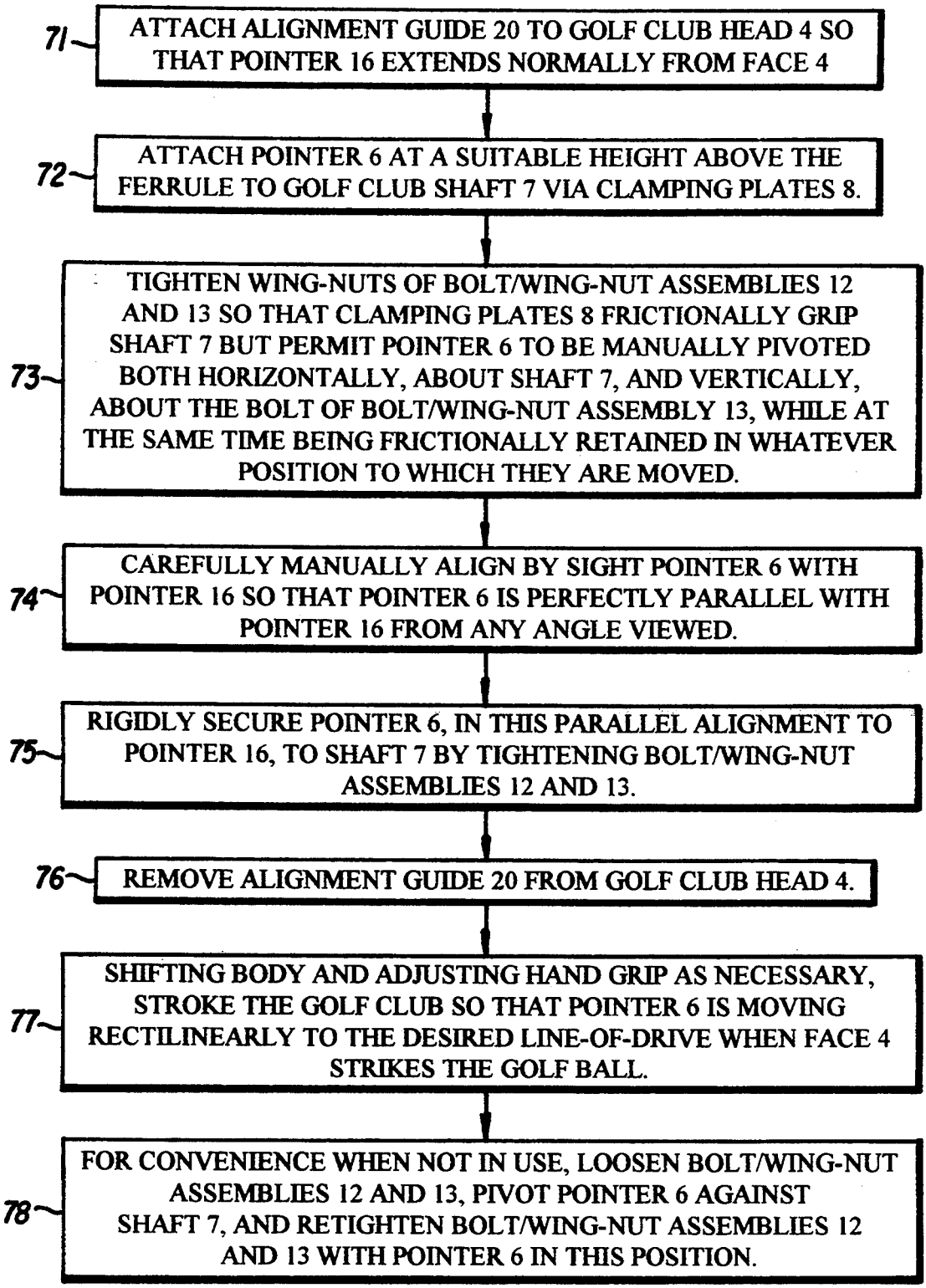
FIG. 7 is a block diagram showing a proper steps in using the apparatus.

Referring to the FIGS. 1 and 2 and 7, a pointer 6 is loosely clamped whereby it is retained at a suitable height, above the ferrule, to shaft 7 of a conventional golf club 5 so that pointer 6, although frictionally retained at its desired location on shaft 7, can be rotated about the longitudinal axis of shaft 7 and also within a plane containing the longitudinal axis (steps 72 and 73 in FIG. 7) to be aligned, (step 74 in FIG. 7) with rod 16 of pointer alignment guide 20 removably attached to face 9 of golf club head 4. Pointer 6, when in precise parallel alignment with pointer 16, is rigidly secured in such position to shaft 7 by tightening bolt/wing-nuts assemblies 12 and 13, (step 75 in FIG. 7).

Figure 5:
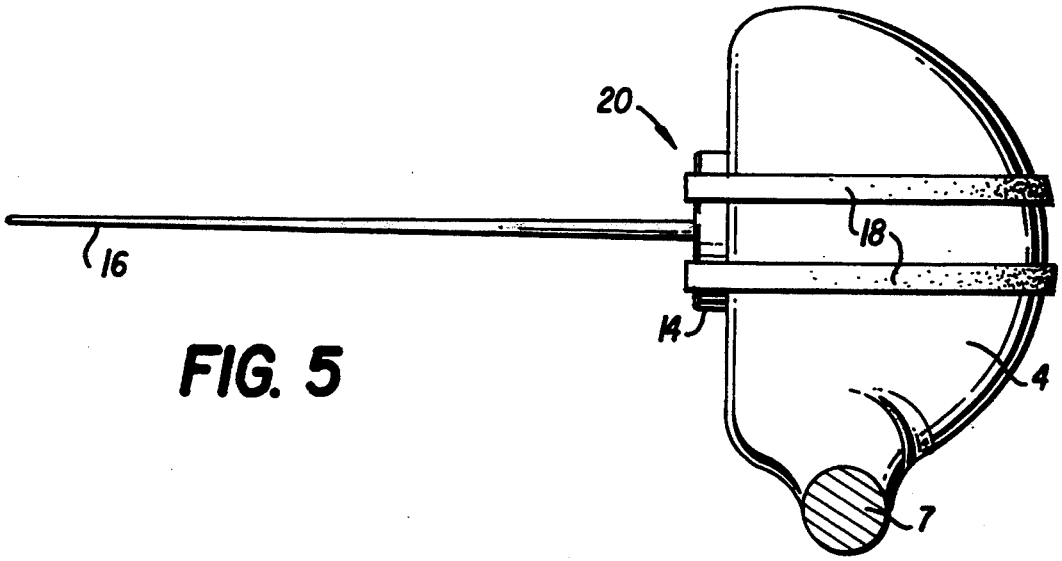
FIG. 5 is a detailed top view of the alignment guide attached by elastic bands to a wood's face.

Golf club 5 may be a putter (shown in FIG. 6), iron, or even a wood (shown in FIG. 5). A "number one" driving iron is shown in FIGS. 1 and 2.

Figure 6:
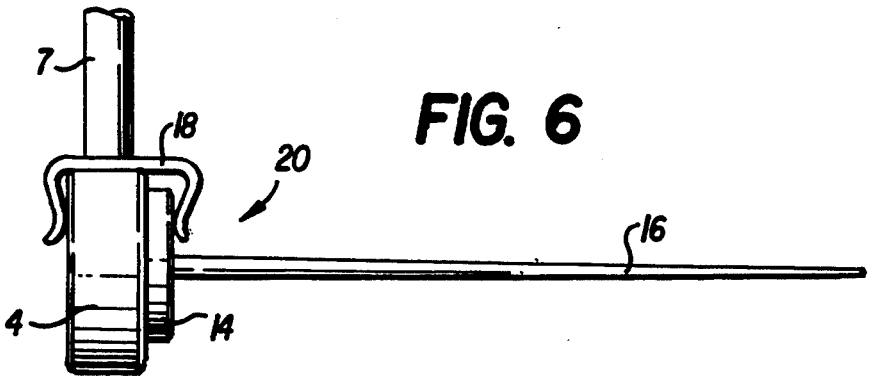
FIG. 6 is a side elevational view of the alignment guide attached by a resilient clamp to a putter's face.

Pointer alignment guide 20 comprises a straight rod 16 that is rigidly attached at one end to a base 14 so that it extends exactly perpendicular therefrom. The side of base 14 opposite to straight rod 16 and which engages face 9 coincides with a plane perpendicular to the longitudinal axis of straight rod 16. Base 14 is mounted on face 9 so that straight rod 16 is directed perpendicularly to striking face 9 of golf club head 4 by preferably a magnet embedded in or comprising base 14 or a spring steel friction grip 18, (as seen in FIG. 6) or an elastic band 18, (as seen in FIG. 5) or any other clamping device 18 which causes base 14 to be detachably, but effectively, connected to face 9.

Figure 3:
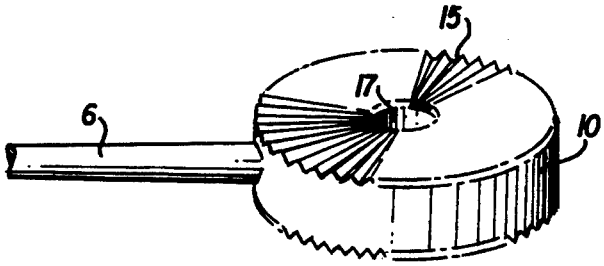
FIG. 3 is a detail perspective view of an adjustment part used in aligning of the shaft mounted pointer with the pointer mounted to the club's face.

Pointer 6 is rigidly connected to a disk or hub 10 and, referring now to FIG. 3, it is seen that hub 10 is provided with a central bore 17 that snugly but slidably receives the shank of a bolt of bolt/wing-nut assembly 13. Hub 10 comprises a flat disc-like structure, its opposite sides being preferably serrated. The serrations 15 on each side of hub 10 extend radially relative to the central axis of bore 17.

Figure 4:
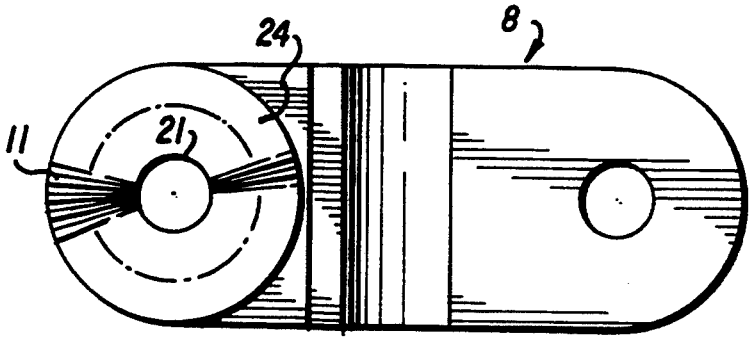
FIG. 4 is a side elevational view of a disassembled clamping plate, in accordance with the invention, illustrating, in particular, the plate's clamping surfaces.

Clamping plates 8 comprise two identical clamping plates, one of which is shown in FIG. 4. As shown in FIG. 4, facing offset areas 24 of clamping plates 8 preferably have a plurality of free grooves 11 that extend radially relative to the center of bolt-hole 21, the bolt of bolt/wing-nut assembly 13 being received in bolt hole 21. Grooves 11 correspond to and are engageable by fine serrations 15 on hub 10.

Referring to FIGS. 1 and 2, hub 10 is positioned between grooves 11 of clamping plates 8, so that serrations 15 on hub 10 and grooves 11 of clamping plates 8 mate. Again referring to FIGS. 1, 2 and 7, the bolt/wing-nut assembly 13 is sufficiently tightened so that hub 10 is frictionally pivotal around the bolt of bolt/wing-nut assembly 13, (step 73 in FIG. 7) until bolt/wing-nut assembly 13 is tightened further, thus rigidly clamping hub 10 and affixing the angle of pointer 6 relative to golf club shaft 7, (step 75 in FIG. 7) which is otherwise manually adjustable when bolt/wing-nut assemblies 12 and 13 are appropriately loosened. Pointer 6, in such connections when it is manually adjustable, may also be pivoted upwardly to be received against or proximate to shaft 7, as shown by step 78 in FIG. 7 and by dashed lines in FIG. 1, whereupon bolt/wing-nut assemblies 12 and 13 are tightened to retain pointer 6 against shaft 7 for convenience when the apparatus is not in use.

The heads of the bolts of bolt/wing-nut assemblies 12 and 13 are preferably rigidly, or at least non-turnably, connected to the adjacent clamping plate of clamping plates 8 so that the bolts do not rotate when the wing nuts are turned.

The apparatus in accordance with the invention is preferably composed of stainless steel, but may be made of other metals, such as aluminum, or appropriately strong and rigid plastics or wood or a combination thereof.

Prior to play, pointer 6 is attached to golf club shaft 7 via clamping plates 8, (step 72 in FIG. 7). Wing-nuts of bolt/wing-nut assemblies 12 and 13 are sufficiently tightened so that clamping plates 8 frictionally grip shaft 7 but permit pointer 6 to be manually pivoted both horizontally, about shaft 7, and vertically, about the bolt of bolt/wing-nut assembly 13 while at the same time, being frictionally retained in whatever position to which they are moved, (step 73 in FIG. 7). Pointer 6 is then carefully and manually aligned by sight with rod 16 of pointer alignment guide 20, as shown in FIG. 2 and step 74 in FIG. 7, guide 16 being temporarily mounted on face 9 of golf club head 4, (step 71 in FIG. 7) by a magnet in base 14 or an elastic band 18, as shown in FIG. 5, or a spring steel friction grip 18, as shown in FIG. 6, or any other mounting means 18. The alignment should be such that pointer 6 and rod 16 are seen to be perfectly parallel from any angle. Wing-nut of bolt/wing-nut assemblies 12 and 13 are then tightened effectively to affix pointer 6 in this position relative to shaft 7, according to step 75 of FIG. 7. Pointer alignment guide 20 is then removed, (step 76 in FIG. 7), and the player sights along pointer 6, shifting body and adjusting hand grip as necessary for causing pointer 6 to be, during the player's striking of the golf ball, pointing in the same direction, maintained parallel to the desired line-of-drive, the player is attempting to drive the golf ball, (step 77 in FIG. 7).

To ensure that pointer 6 remains parallel to the line-of-drive during the portion of the stroke wherein the golf ball is hit, brightly colored areas, which will be visible to the golfer when he or she hits the golf ball, may be applied to pointer 6, one near or at the outward point and another near or at the base where it extends from clamping plates 8 and disk 10. When swinging the golf club, the golfer should see the streaks caused by the rapid movement of such brightly colored areas completely superimposed, indicating that the golf ball is being hit squarely. If the streaks are completely or substantially superimposed, it is considered that the golf club's face is moving "rectilinearly" to impact the golf ball in a stroke that is perpendicular or substantially perpendicular to the face of the golf club's head. If the streaks are parallel or at least not substantially superimposed, the ball is likely to be hooked or sliced because the face impacts the golf ball on a bias.

Although a detailed description of the embodiment is set forth above, it should be understood that various modifications and substitutions can be made by those skilled in the art without abandoning the novel spirit and scope of this invention. For example, pointer 6 may be secured to the golf club's shaft 7 by a quick acting clamp. As another example, a bulb or other blunting object may be rigidly connected to the outward end of pointer 6 to ensure that neither the golfer nor anyone else is injured by the pointer, in use or otherwise. Also, hub 10 may be rotatably movable relative to clamping plates 8 while frictionally engaging a non-serrated surfaces rather than providing serrations 15; but because the golf club may be swung quite forcibly by the user, serrations are preferred because they provide a positive engagement which is less likely to be accidentally dislodged.

Having disclosed my invention, what I claim as new and to be secured by Letters Patent of the United States is:

1. A golf device for aiming a golf ball toward a target by a player with a golf club having a shaft and a face in combination with alignment apparatus, said alignment apparatus comprising; a first pointer which is movably connected to said golf club shaft; means for affixing said first pointer relative to said golf club shaft into a desired disposition; a second pointer for being detachably mounted to said golf club face so as to extend perpendicularly outwardly therefrom; said first pointer being movably alignable into a parallel position with said second pointer and affixed in said parallel disposition by said affixing means to said golf club shaft whereby subsequently a golfer can remove said second pointer from said golf club face and by stroking said golf club so said first pointer is moving rectilinearly in the direction of said target when said golf club face hits said golf ball, said golf ball is thereby driven directly toward said target.

2. A combination in accordance with claim 1 wherein said affixing means comprises a clamp which grasps said shaft so as to be frictionally turnable relative thereto and wherein said first pointer is frictionally movable through a pivotal member supported in said clamp, said first pointer being manually movable horizontally about the longitudinal axis of said shaft and vertically within a plane substantially connecting with said longitudinal axis of said shaft.

3. A combination in accordance with claim 1 wherein said affixing means is received on said shaft above its connection to the golf club head.

4. A combination in accordance with claim 1 wherein said golf club is a putter.

5. A combination in accordance with claim 1 wherein said golf club is an iron.

6. A combination in accordance with claim 1 wherein said golf club is a wood.

7. An aid for straight hitting a golf ball by a golf club which comprises mounting means removably mounted on the shaft of said golf club, said mounting means including pivotal means; a pointer means extending from said pivotal means, said pivotal means for pivoting said pointer means vertically relative to the shaft of said golf club on which said mounting means is mounted; clamping means included in said mounting means for selectively tightening said mounting means relative to said golf club's shaft whereby in a first tightening position said pointer means is selectively pivotable vertically and horizontally relative to said shaft and to be frictionally retained in any desired position which may occur in said pivotable movement, said clamping means having a second tightening position wherein said pointer means is affixed relative to said shaft; and an alignment guide which is removably connected to the face on the head of said golf club, said alignment guide including a straight longitudinally extending member which extends perpendicularly from said face of said golf club on which said shaft said mounting means is mounted, said pointer means being secured in said second tightening position so that it is perfectly parallel to said longitudinally extending member extending perpendicularly from said face.

8. An aid in accordance with claim 7 wherein said pointer means is selectively pivotable horizontally relative to said shaft about the longitudinal axis of said shaft and vertically pivotable relative to said shaft in a plane that includes the longitudinal axis of said shaft.

9. A method for aligning strokes of a golf club so that the golf ball is driven toward a desired target which comprises the steps of placing an alignment guide on the face of said golf club so that it extends perpendicularly therefrom, attaching pointer to the shaft of said golf club and moving said pointer to a disposition where it is perfectly parallel to said alignment guide, affixing said pointer relative to said shaft while in said disposition, removing said alignment guide from said face and stroking said golf club so that said face hits the golf ball and said pointer is moving rectilinearly in the direction of said desired target during the portion of said stroke wherein said golf ball is hit by said golf club.

10. A method in accordance with claim 9 including the further steps of pivoting said pointer upwardly, after said stroke, and securing said pointer against said shaft for storing said golf club.

* * * * *